US005257841A

United States Patent [19]

Geringer et al.

[11] Patent Number: 5,257,841

[45] Date of Patent: Nov. 2, 1993

[54] ELECTRICAL MONITORING STRIKE DEVICE

[76] Inventors: Arthur Geringer, 5029 E. Jacobs Ct., Agoura, Calif. 91301; Richard Geringer, 12628 Ambermeadow, Moorpark, Calif. 93021; David Geringer, 28364 Balkin, Agoura, Calif. 91301

[21] Appl. No.: 966,657

[22] Filed: Oct. 26, 1992

[51] Int. Cl.[5] ..... E05C 13/10

[52] U.S. Cl. ..... 292/340; 292/DIG. 60

[58] Field of Search ..... 292/144, 201, 341.16, 292/340, DIG. 60, 341.18

[56] References Cited

U.S. PATENT DOCUMENTS

| | | | |
|---|---|---|---|
| 1,965,482 | 7/1934 | Walker | 292/144 |
| 2,193,488 | 3/1940 | Morley et al. | 292/340 X |
| 3,770,930 | 11/1973 | Tang | 292/340 X |
| 4,248,463 | 2/1981 | Hand | 292/340 |

*Primary Examiner*—Richard E. Moore
*Attorney, Agent, or Firm*—John J. Posta, Jr.

[57] ABSTRACT

The lock strike device is used with closable openings and is electrically connectable to an electrical monitoring circuit so that the presence or absence of a latch or deadbolt in the device can be automatically detected. The device includes a strike box having spaced sidewalls and a closed rear end. The first sidewall and adjacent portion of the rear end define an elongated cutaway portion through which an elongated blade trigger is spring biased into the strike space. The trigger is hinged at its front end to a box connected to the front of the sidewall. The rear end of the trigger is a head which urges a spring loaded lever arm of an electrical switch mounted on the exterior of the housing rear end into an open circuit position. A movable tab extends transversely into the space from the trigger. The tab senses the presence of a latch to provide a signal to an indicator.

8 Claims, 2 Drawing Sheets

ELECTRICAL MONITORING STRIKE DEVICE

BACKGROUND OF THE INVENTION

1. Field of the Invention

The present invention generally relates to locking means and more particularly to an improved electrical monitoring strike device.

2. Prior Art

Various types of electrical lock systems have been devised in order to monitor doors and windows, and also safes, for security purposes, detecting when they open and close. Most such systems are cumbersome and have lock strike devices which have little ability to fit various sizes and shapes of door and window latches and deadbolts, and the like.

Accordingly, it would be desirable to be able to provide an improved simple, inexpensive, electrical monitoring strike device exhibiting improved adjustability to accommodate latches and deadbolts of various lengths and widths The device should be capable of accepting one or both of a latch and deadbolt and of separately signaling their positions for monitoring purposes.

SUMMARY OF THE INVENTION

The improved electrical lock strike device of the present invention satisfies all the foregoing needs. The device is simple, durable, inexpensive, compact and versatile. It can be made to detect the position of a latch and/or deadbolt and to signal a remote monitor for security purposes. Moreover, it can be adjusted to accept latches and deadbolts of various lengths and widths, shapes and spacings to meet individual needs.

The device includes a strike box having an open front and opposed closed first and second sidewalls connected to a closed rear end to collectively define a strike space within which a latch and/or deadbolt from a door, window or the like is releasably received. The first sidewall has a horizontal cutaways portion extending to and including a part of the corner of the box rear end, into which is spring biased an elongated trigger blade hinged to the first sidewall adjacent the front, so that the blade rear head rotates into and out of the box internal space. A switch is mounted on the exterior of the rear end and bears a switch lever arm spring biased into the rear head of the trigger.

In the resting position, the rear head of the trigger bears strongly against the lever arm, keeping the switch against the switch box and in an open-circuit position. The trigger blade bears a transverse tab or screw projecting to the box space. The tab is adjustable transversely to accommodate deadbolts and latches of various widths. The blade has a plurality of transverse holes spaced longitudinally thereof; that is, along its length into which the tab can be seated to accommodate deadbolts and latches of various lengths. An opening in the second sidewall opposite the holes allows easy access to the box space to reseat the tab, as desired.

When a deadbolt or latch is slid into the box space (mounted in a frame) from a window, door, lid or the like, it forces the rear head of the trigger blade laterally outwardly through the cutaway portion to a position lateral of the lever arm, allowing the lever arm to be automatically spring biased into a closed switch position, completing a circuit to a remote monitor to which the switch is electrically connected by leads, signaling the locked condition of the door, window, etc., as by a light turned on in such circuit. If desired, the circuitry can employ a single pole double throw or double pole double throw switch configuration. By selective wiring this can provide a wet or dry open or closed circuit to light a signal at a guard console or signal a computer. For purposes of clarity, we have selected a circuit which would be open when the bolt has engaged the strike and closed when the bolt is disengaged.

Further features of the electrical lock strike device of the present invention are set forth in the following detailed description and accompany drawings.

DRAWINGS

Figure 1:
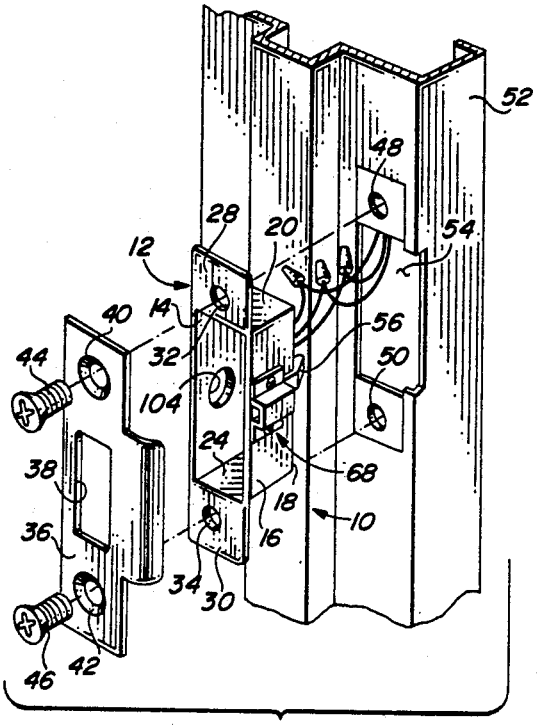
FIG. 1 is an exploded side schematic perspective view of a first preferred embodiment of the improved electrical lock strike device of the present invention.
Figure 2:
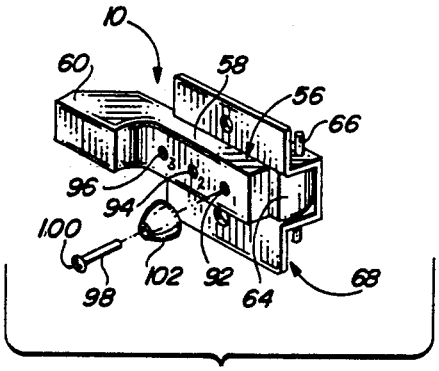
FIG. 2 is an enlarged schematic side perspective view of the trigger of the device of FIG. 1.
Figure 3:
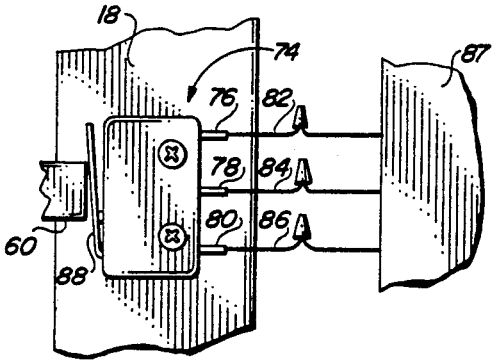
Figure 4:
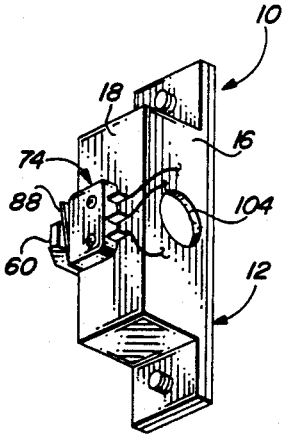
Figure 5:
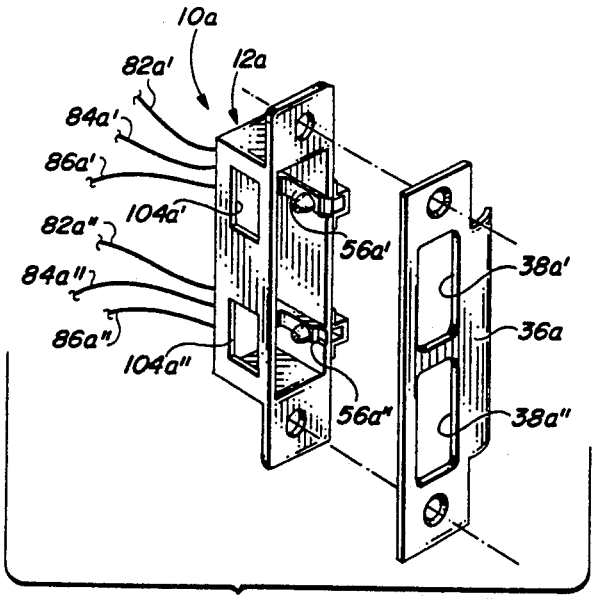
Figure 6:
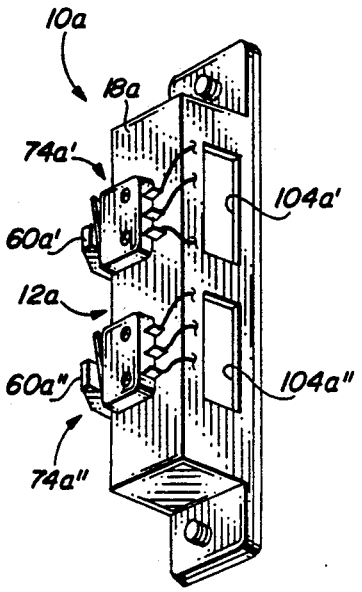
Figure 7:
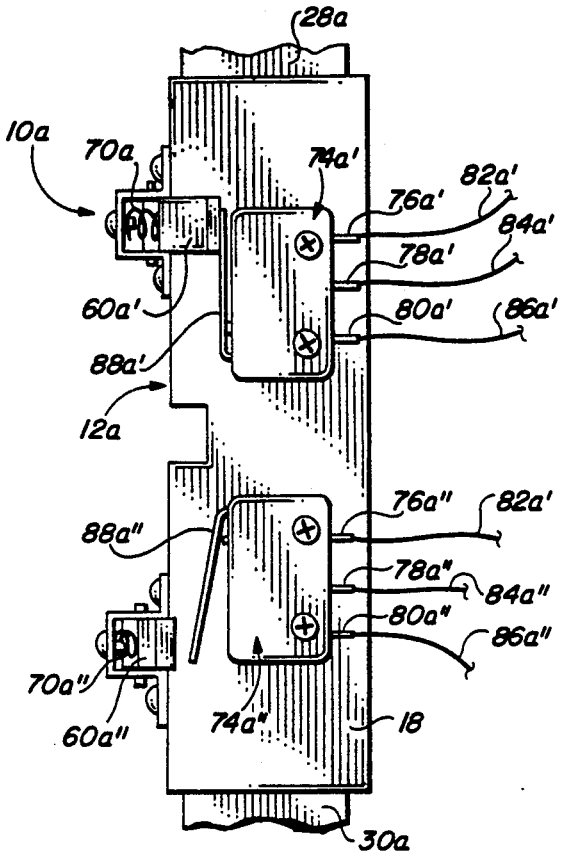
Figure 8:
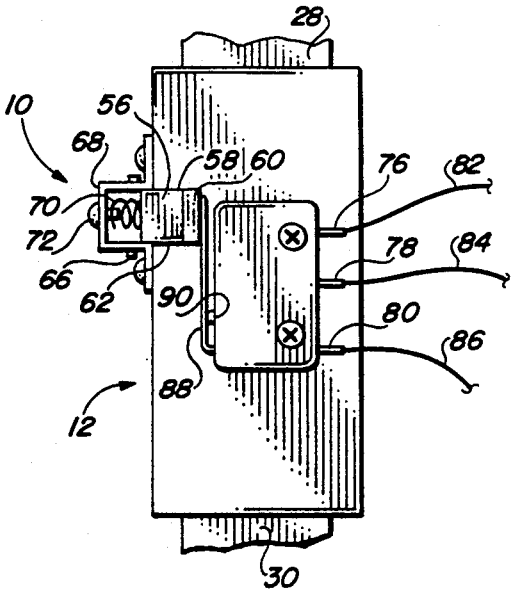

FIG. 3 a schematic diagram depicting electrical connections between the device of FIG. 1 and a remote monitor;

FIG. 4 is a schematic rear perspective view of the device of FIG. 1;

FIG. 5 is a schematic side perspective view of a second preferred embodiment of the improved electrical lock strike device of the present invention;

FIG. 6 is a schematic rear perspective view of the device of FIG. 5;

FIG. 7 is an enlarged schematic rear elevation of the device of FIG. 5, shown with one lever arm in the closed circuit position and the other lever arm in the open circuit position; and, FIG. 8 an enlarged schematic rear elevation of the device of FIG. 1 shown with the lever arm in the open circuit resting position.

DETAILED DESCRIPTION

FIGS. 1–4 and 8

Now referring more particularly to FIGS. 1–4 & 8 of the drawings, a first preferred embodiment of the improved lock strike device of the present invention is schematically depicted therein. Thus, device 10 is shown. It comprises a rectangular strike box in the form of a rectangular housing 12 having a pair of opposed, spaced vertical sidewalls 14 & 16 interconnected with a vertical rear end 18 and interconnected top 20 and bottom 22 defining an open front 24 and central space 26. Housing 12 at the front 24 thereof has a pair of spaced vertical ears 28 & 30 with openings 32 & 34, respectively therein.

Housing 12 in FIG. 1 is shown between a conventional strike plate 36 with central opening 38, and with screw holes 40 and 42 alignable with openings 32 and 34 so that screws 44 and 46 can pass therethrough and into openings 48 and 50 in a window or door frame 52 or the like to releasably secure plate 36 to front 24 and housing 12 in a recess 54 in frame 52. It will be understood that frame 52 could be the edge, if desired, of one of a pair of double doors, or could be the frame of a safe adjacent the safe door, etc.

Housing 12 has (FIG. 2) a trigger 56 comprising an elongated blade 58 with angled rear head 60 disposed in a horizontal cutaway portion 62 extending from front 24 through sidewall 16 to and through a portion of rear end 18 so that head 60 extends inwardly that is medially of sidewall 16 when spring biased to a trigger resting position. The front end 64 of trigger 56 is hinged by a pin 66 to a U-shaped bracket 68 connected to the outer surface of sidewall 16 (FIG. 8) and bearing a coiled bias spring 70 wrapped around a retainer screw 72.

Connected to the outer surface of rear end 18 is an electrical box switch 74 bearing three spaced connectors 76, 78 and 80 to which are connected electrical leads 82, 84 and 86, respectively, running to a conventional remote circuit monitor 87 (FIG. 3). Switch box 74 bears an external switch lever arm 88 normally biased by a spring 90 away from the outer surface of box 74 into a closed circuit position. Arm 88, however, is forced into the open circuit position of FIG. 8 by head 60, itself urged to that position by spring 70. In the open circuit position, for example, no light in remote monitor 87 is lit. This shows trigger 56 to be in the resting or window unlocked position.

Trigger 56 in the resting position extends into space 26. Trigger 56 bear three spaced transverse screw holes 92, 94 and 96 therethrough in which screw 98 can be secured, with screw head 100 thereof adjustably spaced medially of blade 58 by bushing 102. This enables trigger 56 to be adjusted to contact door and window latches and bolts (not shown) of various widths in strike space 26. As such, a latch or bolt is slid into space 26 from a door or window, it strikes screw head 100, forcing trigger head 60 to rotate laterally outwardly through slot 62 against spring 70 and away from switch lever arm 88, allowing spring 90 to move arm 88 to the closed switch position away from box 74, closing a circuit in monitor 87 to indicate, as by a light turned on in that closed circuit, that the door or window is closed and is latched or bolted. Alternatively, switch box 74 could be wired such that in the resting position trigger 56 would hold arm 88 in the closed circuit position, signaling that the relevant door or window is open, not closed and locked. Moving head 60 away from arm 88 would cause an open circuit portion, cutting off the signal.

In order to allow easy access to screw 98, an opening 104 in sidewall 14 is provided, through which a screwdriver or the like tool (not shown) can be inserted to remove screw 98, e.g., from opening 94 and move it into opening 96, thus changing the position of screw head 100 along a transverse line in space 26 and along the length of blade 58 to accommodate latches and dead bolts of various width lengths and spacings. Thus screw head 100 can be positioned so that the "locked" signal with arm 88 moving to the closed circuit position, is only generated when a latch or dead bolt is fully inserted into strike space 26. This provides an additional security function for electrical monitoring strike device 10.

Accordingly, device 10 has improved utility for security purposes, improved adjustability and is inexpensive, durable and simple to install and use in a door or window frame.

FIGS. 5, 6 and 7.

A second preferred embodiment of the improved electrical lock strike device of the present invention is schematically depicted in FIGS. 5–7. Thus, device 10*a* is shown. Components thereof similar to those of device 10 bear the same numerals, but are succeeded by the letter "a".

Device 10*a* is identical to device 10, except that it has two sets of components for dual signaling for both a latch and deadbolt. It differs from device 10 as follows:

a) strike housing 12 is more elongated than housing 12;

b) strike plate 36*a* has two spaced openings 38*a*$^1$ and 38*a*$^{11}$, one above the other, one to receive a deadbolt and the other to receive a latch;

c) there are two triggers 56*a*$^1$ and 56*a*$^{11}$ positioned in strike space 26*a* behind openings 38*a*$^1$ and 38*a*$^{11}$ and strikable by, respectively, a latch and a deadbolt; and, d) there are two switch boxes 74*a*$^1$ and 74*a*$^{11}$ connected to separate monitoring circuits (not shown); trigger heads 60*a*$^1$ and 60*a*$^{11}$ are shown in FIG. 7, respectively, in the resting position (60*a*$^1$) against switch lever arm 88*a*$^1$, and in the closed circuit position, with head 60*a*$^{11}$ away from arm 88*a*$^{11}$.

As with the components of device 10, those of device 10*a* can be made in any suitable size and configuration and of any suitable materials. For example, box or housing 12*a* can be of metal, wood, plastic, ceramic, fiberglass, etc., as can triggers 56*a*$^1$ and 56*a*$^{11}$ and lever arm 88*a*$^1$ and 88*a*$^{11}$. Obviously, connectors 76*a*$^1$ and 76$^{11}$, 78*a*$^1$ and 78*a*$^{11}$, and 80*a*$^1$ and 80*a*$^{11}$, as well as leads 82*a*$^1$ and 82*a*$^{11}$, 84*a*$^1$ and 84*a*$^{11}$, and 86*a*$^1$ and 86*a*$^{11}$, as well as the internal construction of switches 74*a*$^1$ and 74*a*$^{11}$ must be of electrically conductive metal.

Various other changes, modifications, alterations and additions can be made in the improved electrical lock strike device of the present invention, its components and their parameters. All such modifications, changes, alterations and additions as are within the scope of the appended claims form part of the present invention.

What is claimed is:

1. An improved electrical monitoring strike device, said device comprising, in combination:

a) a hollow strike box housing defining a space adapted to receive at least one of a latch and a deadbolt, said housing comprising an open front end adapted to receive an apertured door jamb strike plate, first and second, of opposed, spaced rearwardly extending sidewalls, and a generally closed rear end, said first sidewall and the adjoining portion of said rear end having a cutaway portion providing access to said space;

b) a trigger comprising an elongated blade having a rear head spring biased into a resting position in said space through said cutaway portion, said trigger having a front portion hinged to said sidewall adjacent said front end for side rotation of said trigger head between said resting position and a position lateral of said first sidewall and said housing rear end and said space; and, c) an electrical switch connected to the outside of said rear end of said housing and bearing an external switching lever arm spring biased toward a lateral switch-closed position but urged by the rear end of said trigger in said trigger resting position into an open switch position, said trigger blade including a movable contact tab transversely extending into said space and adapted to contact a latch or deadbolt when the latch is inserted into said space so that the latch or deadbolt urges said trigger out of said resting position into a position lateral of said first sidewall and out of contact with said lever arm, said lever arm then automatically being biased laterally into said closed switch position.

2. The improved lock strike device of claim 1 wherein said switch is in a box fixed to the exterior of said rear end of said housing and bears a plurality of electrical contacts and leads for connection to a remote electrical monitor to sense the position of a latch or deadbolt in said space.

3. The improved lock of claim 2 wherein said contact tab is adjustable transversely to accommodate deadbolts and latches of various widths.

4. The improved lock strike device of claim 3 wherein said contact tab is releasably secured to one of a plurality of longitudinally spaced transverse openings in said trigger blade, whereby the depth of said tab in said housing space is adjustable to accommodate deadbolts and latches of various lengths.

5. The improved lock strike device of claim 4 wherein said second sidewall has a cutaway portion opposite said tab transverse openings to facilitate insertion of a tool into said space for lateral and longitudinal adjustment of said tab.

6. The improved lock strike device of claim 7 wherein said housing has a pair of said triggers disposed above one another and a pair of electrical switches aligned therewith on the outer surface of the rear end of said housing to separately detect the position of a latch and a deadbolt when in said strike space.

7. The improved lock strike device of claim 5 wherein said tab is a headed screw, the head of which extends into said space and wherein said spaced transverse openings are screw holes.

8. The improved lock strike device of claim 1 wherein said device is one of a door and window lock strike device, wherein said trigger front portion is hinged to a box connected to said first sidewall adjacent to said cutaway portion in said first sidewall and wherein said box contains a spring biasing said trigger into said resting position.

* * * * *